US007855612B2

(12) United States Patent
Zienkewicz et al.

(10) Patent No.: US 7,855,612 B2
(45) Date of Patent: Dec. 21, 2010

(54) DIRECT COAXIAL INTERFACE FOR CIRCUITS

(75) Inventors: Rob Zienkewicz, Chandler, AZ (US); Dean Cook, Mesa, AZ (US); Charles Woods, Gilbert, AZ (US)

(73) Assignee: Viasat, Inc., Carlsband, CA (US)

( * ) Notice: Subject to any disclaimer, the term of this patent is extended or adjusted under 35 U.S.C. 154(b) by 0 days.

(21) Appl. No.: 11/874,369

(22) Filed: Oct. 18, 2007

(65) Prior Publication Data

US 2009/0102575 A1 Apr. 23, 2009

(51) Int. Cl.
*H01P 5/103* (2006.01)

(52) U.S. Cl. ..... 333/26; 333/33

(58) Field of Classification Search ..... 333/26, 333/33, 247

See application file for complete search history.

(56) References Cited

U.S. PATENT DOCUMENTS

| | | | | |
|---|---|---|---|---|
| 4,608,713 | A * | 8/1986 | Shiomi et al. | 455/325 |
| 4,868,639 | A * | 9/1989 | Mugiya et al. | 257/699 |
| 4,967,168 | A * | 10/1990 | Bacher et al. | 333/26 |
| 5,045,820 | A * | 9/1991 | Leicht et al. | 333/26 |
| 5,170,142 | A | 12/1992 | Bier | |
| 5,198,786 | A * | 3/1993 | Russell et al. | 333/26 |
| 5,218,373 | A | 6/1993 | Heckaman et al. | |
| 5,361,049 | A | 11/1994 | Rubin et al. | |
| 5,376,901 | A * | 12/1994 | Chan et al. | 333/33 |
| 5,468,380 | A | 11/1995 | Yabuuchi | |
| 5,488,380 | A | 1/1996 | Harvey et al. | |
| 5,678,210 | A * | 10/1997 | Hannah | 455/128 |
| 5,945,894 | A | 8/1999 | Ishikawa et al. | |
| 5,969,580 | A * | 10/1999 | Maillet et al. | 333/26 |
| 6,232,849 | B1 * | 5/2001 | Flynn et al. | 333/26 |
| 6,265,590 | B1 | 7/2001 | Samukov | |
| 6,265,950 | B1 | 7/2001 | Schmidt et al. | |
| 6,363,605 | B1 | 4/2002 | Shih et al. | |
| 6,803,837 | B2 | 10/2004 | Ishida et al. | |
| 7,068,121 | B2 | 6/2006 | Ding et al. | |
| 7,486,157 | B2 | 2/2009 | Takagi | |
| 2004/0038587 | A1 | 2/2004 | Yeung et al. | |
| 2005/0191869 | A1 | 9/2005 | Oldfield | |
| 2007/0096805 | A1 | 5/2007 | Kim et al. | |

FOREIGN PATENT DOCUMENTS

| | | |
|---|---|---|
| EP | 0954045 | 11/1999 |

(Continued)

OTHER PUBLICATIONS

International Search Report and Written Opinion from related PCT application (PCT/US2008/062095) dated Aug. 8, 2008.

(Continued)

*Primary Examiner*—Benny Lee
(74) *Attorney, Agent, or Firm*—Snell & Wilmer, L.L.P.

(57) ABSTRACT

In general, in accordance with an exemplary aspect of the present invention, a low-loss interface for connecting an integrated circuit such as a monolithic microwave integrated circuit to an energy transmission device such as a waveguide is disclosed. In one exemplary embodiment, the interface comprises a coaxial structure such as a coaxial cable that directly connects the monolithic microwave integrated circuit to the waveguide to transmit energy such as microwave energy with minimal loss.

17 Claims, 2 Drawing Sheets

FOREIGN PATENT DOCUMENTS

| | | |
|---|---|---|
| EP | 1744395 | 1/2007 |
| JP | 06-338709 | 12/1994 |
| JP | 1998-289767 | 10/1998 |
| JP | 2001-177311 | 6/2001 |
| KR | 2000-0004040 | 2/2000 |
| KR | 2001-0091539 | 10/2000 |
| WO | 0300597 | 3/2003 |
| WO | WO 03/084001 | 10/2003 |

OTHER PUBLICATIONS

First Written Opinion of International PCT Application No. PCT/US2008/075969 dated Nov. 18, 2008.
International Preliminary Report on Patentability for International Application No. PCT/US2008/062095 dated May 20, 2009.
Office Action for U.S. Appl. No. 11/853,287 dated Mar. 2, 2010.
Notice of Allowance for U.S. Appl. No. 11/743,496 dated Oct. 1, 2009.
Office Action for U.S. Appl. No. 11/853,287 dated Apr. 15, 2009.
Office Action for U.S. Appl. No. 11/853,287 dated Nov. 12, 2009.
Office Action for U.S. Appl. No. 12/039,529 dated Nov. 27, 2009.
First Written Opinion for International Application No. PCT/US2009/037023 dated Oct. 12, 2009.
Notice of Allowance dated Jun. 16, 2010 for U.S. Appl. No. 11/853,287.
Nonfinal Office Action dated Dec. 12, 2008 for U.S. Appl. No. 11/743,496.
Nonfinal Office Action dated Mar. 2, 2010 for U.S. Appl. No. 11/853,287.
Final Office Action dated Nov. 12, 2009 for U.S. Appl. No. 11/853,287.
Nonfinal Office Action dated Apr. 15, 2009 for U.S. Appl. No. 11/853,287.
Nonfinal Office Action dated Nov. 27, 2009 for U.S. Appl. No. 12/039,529.
Notice of Allowance dated Oct. 1, 2009 for U.S. Appl. No. 11/743,496.
Notice of Allowance dated Apr. 6, 2009 for U.S. Appl. No. 11/743,496.
International Preliminary Report on Patentability dated Mar. 16, 2010 for International Patent Application No. PCT/US2008/075969.
Nonfinal Office Action dated Apr. 16, 2010 for U.S. Appl. No. 11/874,369.
Final Office Action dated Apr. 19, 2010 for U.S. Appl. No. 12/039,529.
PCT/US2009/037023 International Preliminary Report on Patentability dated Sep. 14, 2010.
Notice of Allowance for U.S. Appl. No. 12/039,529 dated Jul. 22, 2010.

* cited by examiner

DIRECT COAXIAL INTERFACE FOR CIRCUITS

FIELD OF INVENTION

The present invention generally relates to an interface for use, for example, between a circuit and a waveguide. More particularly, the present invention relates to an interface comprised of a coaxial structure that transports signals from, for example, an integrated circuit, such as a monolithic microwave integrated circuit, to a waveguide with minimal signal loss.

BACKGROUND OF THE INVENTION

There are numerous circuits and other electronic devices that produce energy waves such as electromagnetic waves and microwaves. These circuits produce energy waves that are delivered to a destination through different wires, guides, and other mediums.

Energy waves can be difficult to control on various circuits, cables, wires, and other mediums that transport the energy waves because these mediums are "lossy." Lossy materials and mediums lose energy by radiation, attenuation, or dissipation as heat. By being lossy, a portion of the signal is lost as is travels through the circuits, wires, and other mediums. Stated another way, a signal entering a lossy material will be greater at the point of entry than at the point of exit.

Microwave energy is particularly difficult to control as many of the materials and mediums that transport microwave energy are lossy. One exemplary circuit that generates and transports microwaves is a "monolithic microwave integrated circuit" or "MMIC." Lost signal waves are unusable and decrease the efficiency of a MMIC as the signal strength decreases due to loss. Generally, the higher the frequency of the microwave, the more lossy the transmission medium and more inefficient the circuit. In certain applications, even signal losses that reduce the signal by small amounts, such as 1/10 of a decibel may result in a significant performance loss. One exemplary application where loss from energy waves such as microwaves is problematic is a power amplifier.

One structure used to reduce lossiness is a waveguide. Waveguides are structures that guide energy waves with minimal signal loss. Unfortunately, signal loss is still problematic with certain waves because the connection or interface between the circuit generating the energy waves and the waveguide can be lossy itself. This is especially an obstacle with a MMIC generating microwaves. Moreover, impedance miss-matches also cause signal losses. For example, the impedance of the MMIC, for example fifty ohms, may not match the impedance of the connected waveguide, for example two hundred and seventy ohms. In this example, an interface between the waveguide and MMIC attempts to match the fifty ohm impedance of the MMIC with the two hundred and seventy ohm impedance of the waveguide. These types of interfaces are known generally as "impedance matching interfaces" or "impedance matching and transforming interfaces."

Besides impedance, circuits such as MMICS also have different modes of energy wave propagation compared to other energy transporting devices such as a waveguide. For example, a MMIC may have a mode of energy wave propagation of quasi-TEM (Transverse Electromagnetic) while a waveguide has a mode of energy wave propagation of $TE_{10}$ (Transverse Electric, 10). These differing modes of energy wave propagation also contribute to loss in traditional interfaces. Impedance matching interfaces also match the differing modes of energy wave propagation to minimize loss.

Present interfaces between a MMIC and waveguide comprise numerous structures that include wirebonds, microstrips, pins, and other devices to connect a circuit to a waveguide or another structure. These interfaces also attempt to match and transform the impedance of the MMIC to the impedance at the waveguide. However, present impedance and mode of energy wave propagation matching interfaces between an integrated circuit such as a MMIC and a waveguide still have an unacceptable amount of loss.

Certain present impedance matching interfaces comprise devices with coaxial structures. Specifically, coaxial cable is used as an impedance matching interface depending on how it is used. Specifically, coaxial structures are utilized as impedance matching interfaces when their impedance is somewhere in between the impedance of the devices they are connecting. For example, a MMIC may have an impedance of fifty ohms and a waveguide may have an impedance of two hundred and seventy ohms. A coaxial structure may be used as part of the interface connecting the MMIC to the waveguide with an impedance of one hundred ohms. This impedance of one hundred ohms helps reduce loss of energy traveling from the fifty ohm MMIC to the two hundred and seventy ohm waveguide. Loss is reduced because the impedance of the devices transporting the energy changes much more gradually (fifty-hundred-two hundred and seventy) than merely connecting the MMIC to the waveguide (fifty-two hundred and seventy).

Despite their impedance matching abilities, many known impedance matching interfaces are complex as they comprise several different parts and require numerous mechanisms to be connected to circuits or other energy transmission devices. Further, known coaxial impedance matching interfaces are not used to directly connect an integrated circuit such as a MMIC to another energy transmission device such a waveguide.

One present interface that does minimize loss and accurately match impedance is described in commonly owned U.S. Pat. No. 7,625,131 issued on Dec. 1, 2009 entitled "Interface for Waveguide Pin Launch" wherein such patent is incorporated in its entirety, by reference. While this patent discloses an excellent interface, the interface does have several parts. Another present interface that reduces loss is disclosed in co-pending, commonly owned U.S. patent application Ser. No. 11/853,287 entitled "Low Loss Interface" which is also incorporated in its entirety by reference. This application also discloses an excellent impedance matching device, but this device too has numerous parts. It would be desirable to provide an impedance matching interface with a coaxial structure that directly connects a circuit such as a MMIC to a waveguide.

Therefore, it would be advantageous to provide a coaxial interface that directly connected an integrated circuit, such as a MMIC, to a waveguide, or other structure that reduces signal loss by matching the impedance. It would also be advantageous to produce a coaxial interface that reduced loss that was inexpensive and easy to manufacture, particularly one that was constructed from parts that were commercially available such a coaxial cable or other type of coaxial materials.

SUMMARY OF THE INVENTION

In general, in accordance with one exemplary aspect of the present invention, a coaxial interface for directly connecting an integrated circuit such as a MMIC to a waveguide is provided. In one exemplary embodiment, the interface is a coaxial cable that directly connects the intergrated circuit to the waveguide. The coaxial structure has an impedance in between that of the integrated circuit and waveguide and assists in transforming the impedance between the integrated circuit and waveguide to reduce loss. In other exemplary embodiments, other coaxial structures are used such as coaxial pins to directly connect an integrated circuit such as a MMIC to a waveguide or other energy transmitting structure or device.

BRIEF DESCRIPTION OF THE DRAWING

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

Figure 1:
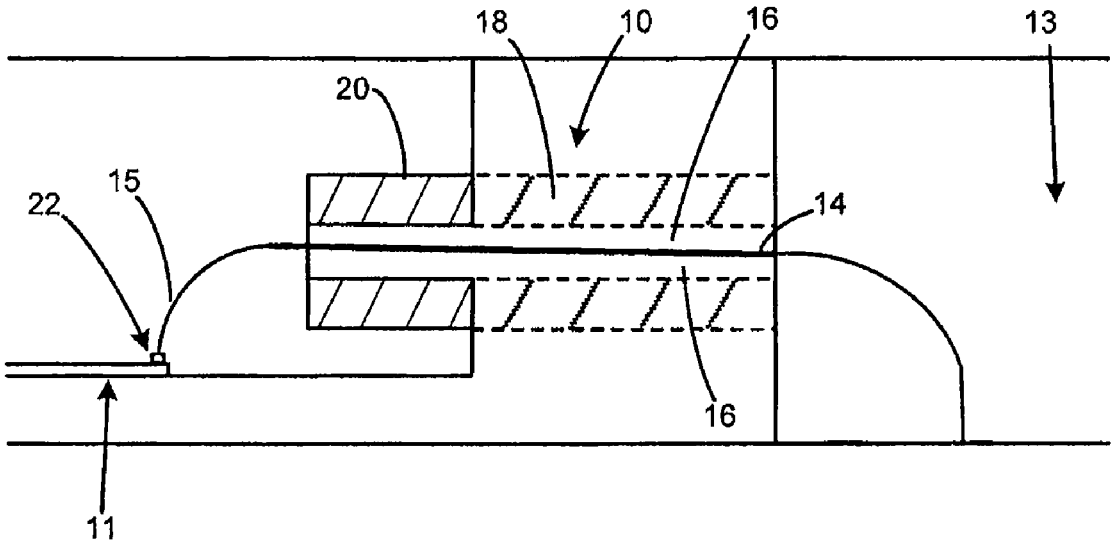
FIG. 1 illustrates an exemplary schematic diagram of a side view of the interface in accordance with an exemplary embodiment of the present invention.

In accordance with one aspect of the present invention, a coaxial interface for connecting a circuit to an energy transmission device such as a waveguide is disclosed. Throughout, the interface will be referred to as coaxial interface 10.

With reference to FIGS. 1-2A and 2B, and in accordance with an exemplary embodiment of the present invention, coaxial interface 10 is a low-loss interface comprising a coaxial structure that is configured to transmit energy between two devices that it is directly connected or coupled to. It should be noted that the term "low-loss" refers to the ability to reduce signal loss as discussed above. In an exemplary embodiment, coaxial interface 10 connects a circuit 11 to another energy transmission device 13. Furthermore, coaxial interface 10 can be any device with a coaxial structure configured to transmit energy with minimal loss by matching or transforming impedance and modes of energy wave propagation between two or more energy producing or transmission devices.

In one exemplary embodiment, circuit 11 is an integrated circuit such as a monolithic microwave integrated circuit (MMIC). In another exemplary embodiment, circuit 11 comprises discrete components on a circuit board, such as memory devices, power sources, light emitting diodes, and the like. Circuit 11 can be any type of circuit, integrated circuit, circuit board, printed circuit board, or other type of device or medium that produces or transfers energy waves. As such, the term "circuit" is not limited to devices with discrete components on a circuit board but rather includes any device that produces or transmits energy waves such as wires, cables, or waveguides. Similarly, energy transmission device 13 can be any type of device or medium configured to produce or transport energy. In one exemplary embodiment, energy transmission device 13 is a waveguide that guides microwave energy waves. In another exemplary embodiment, energy transmission device 13 comprises wires, cables or other devices configured to transport and guide energy waves from one source to another.

Further, it should be noted that while this application gives examples of energy traveling from circuit 11 to energy transmission device 13 through coaxial interface 10, that energy can travel in the other direction from energy transmission device 13 to circuit 11 and still fall within the scope of the present invention. According to these exemplary embodiments, energy can be produced or originate at energy transmission device 13 and travel through coaxial interface 10 to reach circuit 11.

In an exemplary embodiment, coaxial interface 10 is any device with two or more layers that share a common axis that is configured to transport energy with minimal loss. Further, an exemplary coaxial interface 10 has an impedance that is in between the impedance of the two devices it is directly connected to. The impedance of coaxial interface 10 is determined by the ratio of the outer to inner diameters of the coaxial interface 10 and an insulating material such as a spacer as described below. One exemplary coaxial interface 10 with a fifty ohm impedance has an inner diameter of 0.0255 inches, an outer diameter of 0.66 inches, and a spacer with a dielectric of T-PTFE with a relative dielectric constant of 1.3. Reducing the ratio of outer to inner diameters lowers the impedance and increasing the ratio of outer to inner diameters increases the impedance. Further, providing a spacer with a lower dielectric constant increases the impedance and providing a spacer with a higher dielectric constant decreases the impedance. Changing the length of coaxial interface 10 will also affect its impedance transforming capabilities for a given frequency.

In one exemplary embodiment, coaxial interface 10 comprises a pin 14 surrounded by three layers such as a spacer 16, a conductor sheath 18, and an insulating jacket 20. According to this exemplary embodiment, coaxial interface 10 is directly connected to circuit 11 and energy transmission device 13 such as a waveguide. According to one exemplary embodiment, pin 14 is constructed from an electrically conductive low-loss medium such as solid gold, silver, copper, and/or other similar materials with low resistance. Pin 14 also generally defines the central axis of coaxial interface 10. Pin 14 can be a single piece of metal or it can be a constructed from numerous smaller pieces of metal that are joined together. Certain exemplary pins therefore comprise numerous strands of low-loss conductive material that are braided together to form pin 14.

Pin 14 can also be any shape, for example, pin 14 can be round, square, or rectangular. In one exemplary embodiment, pin 14 is a relatively long, narrow member that is round. Other shapes of pin 14 in other exemplary embodiments of the present invention comprise an oval, square, rectangular shaped, irregularly shaped or the like. In one exemplary embodiment, pin 14 is one continuous shape from one end to the other. In other exemplary embodiments, half of pin 14 can be round while the other half is another shape (such as an oval) resulting in pin 14 having two shaped regions. Numerous different shaped regions can be located along pin 14.

Figure 2A:
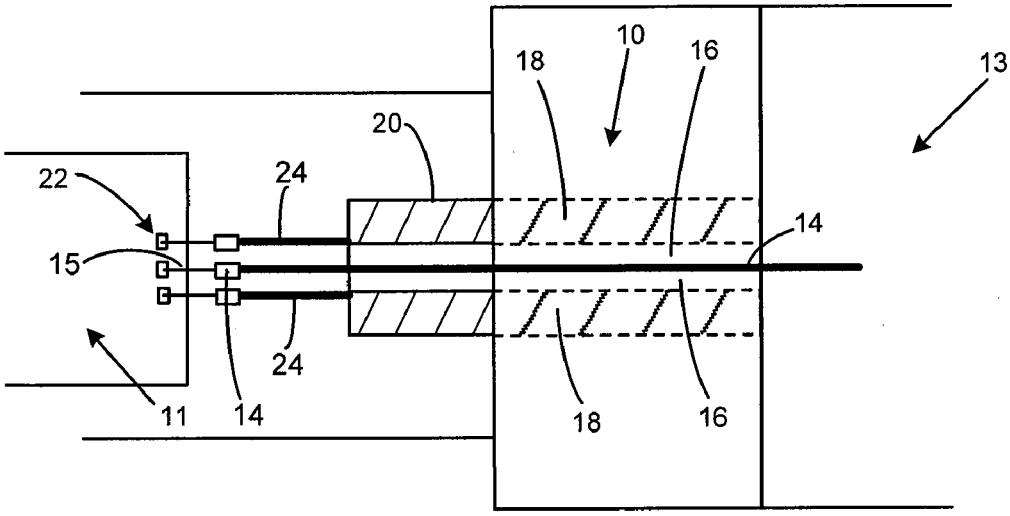
FIGS. 2A-2B illustrate a top view of the interface and a side view of a flexible interface in accordance with an exemplary embodiments of the present invention.

With reference to FIG. 1 and FIG. 2A and in accordance with one exemplary embodiment of the present invention, pin 14 may also extend out of and away from spacer 16, conductor sheath 18, and insulating jacket 20 to contact circuit 11 on one end and energy transmission device 13 on the opposing end. Pin 14 may also contact circuit 11 at certain connection points such as one or more bond pads 22. Pin 14 may be may soldered or connected to bond pad 22 by any known method in the art such as an adhesive, soldering, or attachment devices such as pins and screws. In one exemplary embodiment, pin 14 is wire bonded to bond pad 22 by a first wire bond 15.

With reference to FIG. 2A and in accordance with an exemplary embodiment of the present invention, coaxial interface 10 may further comprise one or more ground wires 24 that connect coaxial interface 10 to circuit 11. In this exemplary embodiment, coaxial interface 10 comprises a ground-signal-ground interface with both ground wires 24 flanking pin 14. In one exemplary embodiment, pin 14 and ground wires 24 are connected to circuit 11 such as a MMIC at bond pads 22.

Spacer 16 is any device or material that is configured to act as an insulator. In one exemplary embodiment, spacer 16 is a dielectric material such as PTFE such as TEFLON® brand Polytetraflouraethylene produced by the E. I. Du Pont De Nemours and Company of Wilmington, Del. Further, spacer 16 can be constructed of a solid material or a perforated material with air spaces. In yet other exemplary embodiments, spacer 16 is nothing more than a space that can comprise air or a vacuum. In an exemplary embodiment where spacer 16 comprises air or a vacuum, spacer 16 functions as an ideal dielectric with no loss.

Figure 2B:
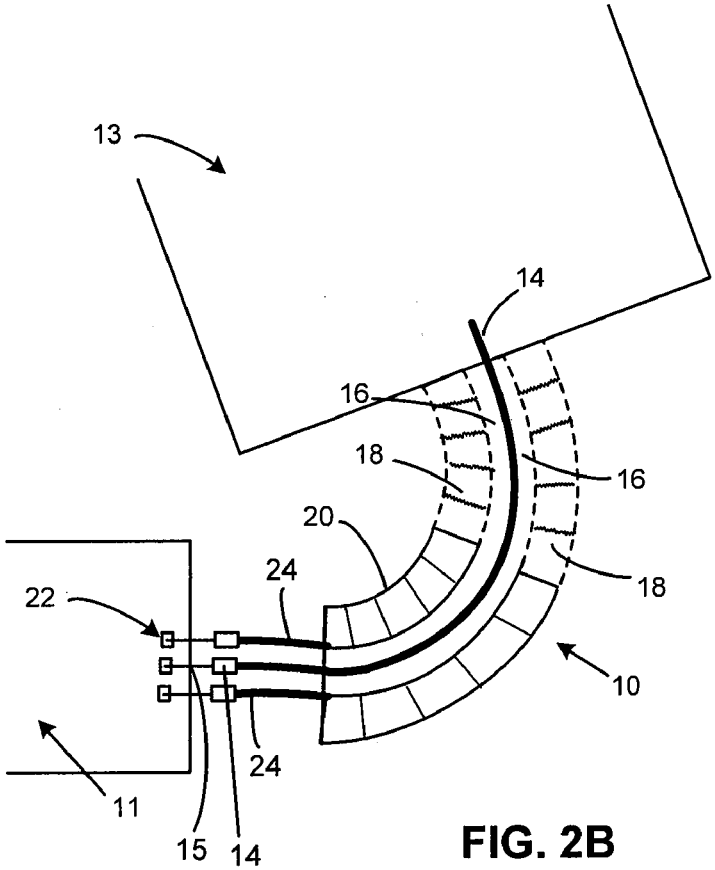

With reference to FIGS. 2A-2B, in one exemplary embodiment, conductor sheath 18 is a cylindrical member that concentrically surrounds the spacer 16. Conductor sheath 18 can be any type of material configured to conduct electricity with low loss. Certain exemplary materials include solid gold, silver, copper, and/or other similar materials with low resistance. Further, conductor sheath 18 can be rigid or flexible (as depicted in FIG. 2B) depending on whether a rigid or flexible coaxial interface 10 is desired. For example, if a rigid coaxial cable is used, conductor sheath 18 is rigid. Alternatively, if a flexible coaxial cable is used, conductor sheath 18 is flexible. Insulating jacket 20 covers and surrounds conductor sheath 18.

In one exemplary embodiment, coaxial interface 10 is a rigid or flexible coaxial cable such as the types that are readily available from numerous commercial sources such as Haverhill Cable and Manufacturing Corporation of Haverhill, Mass. In other exemplary embodiments, coaxial interface 10 is a coaxial pin available from various commercial sources such as Thunderline Z (a division of Emerson, Inc.) of Hampstead, N.H., Special Hermetic Products, Inc. of Wilton, N.H., and Mill-Max Manufacturing Corporation of Oyster Bay, N.Y.

The choice between using a rigid coaxial interface 10 and a flexible coaxial interface 10 depends on the application. For example, if coaxial interface 10 is used in a small area that is subject to vibrations or other movement, it might be desirable to utilize a flexible coaxial interface 10 such as a coaxial cable. However, if coaxial interface 10 is used in an area where physical strength and durability of coaxial interface 10 are important, using a rigid coaxial interface 10 would be more appropriate.

In yet other exemplary embodiments, coaxial interface 10 can be any device with a coaxial structure that is constructed of two or more parts that are joined together to create a coaxial structure. In this exemplary embodiment, the parts of the coaxial interface 10 are coaxial structures themselves and when they are connected or otherwise joined together, these individual coaxial parts create a coaxial interface created from at least two or more coaxial parts. Certain exemplary coaxial structures are disclosed in commonly owned U.S. Pat. No. 7,625,131 entitled "Interface for Waveguide Pin Launch." Any number of parts, assemblies, or other devices can be used to create coaxial interface 10 and fall within the scope of the present invention.

In an exemplary embodiment, coaxial interface 10 transmits energy such as microwaves from circuit 11 to energy transmission device 13 with minimal loss by providing a pathway with an impedance that is in between the impedance of circuit 11 and energy transmission device 13 for energy to travel through as it encounters these changes in impedance and modes of energy wave propagation between circuit 11 and energy transmission device 13. For example, the impedance of the energy source at circuit 11 may be fifty ohms while the impedance of the energy transmission device 13 is two hundred and seventy ohms. Normally, these changes of impedance between interface circuit 11 and energy transmission device 13 would generate unacceptable signal loss. Coaxial interface 10 reduces this loss because its impedance is between the impedance of circuit 11 and energy transmission device 13. Essentially, this "steps down" or "steps up" (depending on the direction of travel) the impedance from circuit 11 to energy transmission device 13 and reduces loss by providing a middle ground impedance thus enabling coaxial interface 10 to have impedance transforming capabilities.

In an exemplary embodiment, increasing or decreasing the electrical length of coaxial interface 10 affects its impedance transforming capabilities at a given frequency.

Besides impedance, circuit 11 and energy transmission device 13 also have different modes of energy wave propagation. For example, a mode of energy wave propagation for energy transmission device 13 such as a waveguide may be $TE_{10}$ (Transverse Electric, 10) while circuit 11 such as a MMIC may have a microstrip mode of wave propagation of quasi-TEM (Traverse Electromagnetic).

As discussed above, the present invention provides a direct connection between circuit 11 and transmission device 13. In an exemplary embodiment, a coaxial structure such as a coaxial cable is used and directly connected to a MMIC on one end and a waveguide on the other opposing end.

While the principles of the invention have now been made clear in illustrative embodiments, there will be immediately obvious to those skilled in the art many modifications of structure, arrangements, proportions, the elements, materials and components, used in the practice of the invention which are particularly adapted for a specific environment and operating requirements without departing from those principles. These and other changes or modifications are intended to be included within the scope of the present invention, as expressed in the following claims.

What is claimed is:

1. An electrical system comprising:

an integrated circuit configured to produce energy waves, wherein the integrated circuit has a first impedance and a first mode energy wave propagation;

an energy transmission device configured to transmit the energy waves, wherein the energy transmission device has a second impedance and a second mode of energy wave propagation; and a flexible coaxial cable comprising a pin, surrounded by a spacer which is concentrically surrounded by an insulating jacket, and wherein the pin is directly connected by a first wirebond to the integrated circuit and connected to the energy transmission device, wherein the flexible coaxial cable is configured to transmit the energy waves between the integrated circuit and the energy transmission device with minimal loss by transforming the impedance the energy waves experience as the energy waves travel along the flexible coaxial cable.

2. The electrical system according to claim 1, wherein the energy transmission device is a waveguide.

3. The electrical system according to claim 1, wherein the integrated circuit is a monolithic microwave integrated circuit.

4. The electrical system according to claim 3, wherein the energy transmission device is a waveguide.

5. A method of transmitting energy with minimal loss comprising:

providing an integrated circuit that produces energy waves wherein the integrated circuit has a first impedance;

providing an energy transmission device configured to transmit the energy waves wherein the energy transmission device has a second impedance;

directly connecting a coaxial interface comprised of a pin, spacer, and an insulating jacket to the integrated circuit with a first wirebond on one end of the coaxial interface and directly connecting to the energy transmission device on an opposing end of the coaxial interface wherein the impedance of the coaxial interface changes from the one end of the coaxial interface to the opposing end of the coaxial interface;

transmitting the energy waves from the integrated circuit through the coaxial interface and transforming the impedance the energy waves experience as the energy waves travel along the coaxial interface; and delivering the energy waves to the energy transmission device wherein the impedance that the energy waves experiences near the energy transmission device has been transformed by the coaxial interface.

6. The method according to claim 5, wherein the coaxial interface is a coaxial cable.

7. The method according to claim 5, wherein the integrated circuit is a monolithic microwave integrated circuit.

8. The method according to claim 7, wherein the impedance of the monolithic microwave integrated circuit is about fifty ohms and the impedance of the energy transmission device is about two hundred and seventy ohms.

9. The method according to claim 8, wherein a first mode of energy wave propagation at the monolithic microwave integrated circuit is quasi-TEM and a second mode of energy wave propagation at the energy transmission device is $TE_{10}$.

10. The method according to claim 9, wherein the energy transmission device is a waveguide.

11. An electrical system comprising:

a monolithic microwave integrated circuit, wherein the monolithic microwave integrated circuit has a first impedance of about fifty ohms and a first mode of energy wave propagation;

a waveguide configured to transmit energy waves, wherein the waveguide has a second impedance of about two hundred and seventy ohms and a second mode of energy wave propagation; and a coaxial interface comprising a pin, surrounded by an insulating jacket directly connected by a first wirebond to the monolithic microwave integrated circuit and connected to the waveguide, wherein the coaxial interface is configured to transmit the energy waves between the monolithic microwave integrated circuit and the waveguide with minimal loss.

12. The electrical system according to claim 11, wherein the first mode of energy wave propagation at the monolithic microwave integrated circuit is quasi-TEM and the second mode of energy wave propagation at the waveguide is $TE_{10}$.

13. The electrical system according to claim 11, wherein the coaxial interface is a coaxial cable.

14. An electrical system comprising:

a monolithic microwave integrated circuit configured to produce energy waves with an impedance of about fifty ohms and a first mode of energy wave propagation of quasi-TEM;

a waveguide configured to transmit the energy waves with an impedance of about two hundred and seventy ohms and a second mode of energy wave propagation of $TE_{10}$; and a coaxial interface comprising a pin, surrounded by a spacer and an insulating jacket directly connected by a first wirebond to the monolithic microwave integrated circuit and connected to the waveguide, wherein the coaxial interface is configured to transmit the energy waves between the monolithic microwave integrated circuit and the waveguide with minimal loss.

15. The electrical system according to claim 14, wherein the coaxial interface is a coaxial cable.

16. The electrical system according to claim 14, wherein the coaxial interface is a flexible coaxial cable.

17. The electrical system according to claim 14, wherein the coaxial interface is a rigid member.

* * * * *